US010156427B2

(12) United States Patent
Litwin

(10) Patent No.: US 10,156,427 B2
(45) Date of Patent: Dec. 18, 2018

(54) MULTI-SPECTRAL CAMOUFLAGE DEVICE AND METHOD

(71) Applicant: Stanislaw Litwin, Razków (PL)

(72) Inventor: Stanislaw Litwin, Razków (PL)

( * ) Notice: Subject to any disclaimer, the term of this patent is extended or adjusted under 35 U.S.C. 154(b) by 381 days.

(21) Appl. No.: 14/961,278

(22) Filed: Dec. 7, 2015

(65) Prior Publication Data

US 2016/0169631 A1 Jun. 16, 2016

Related U.S. Application Data

(60) Provisional application No. 62/090,574, filed on Dec. 11, 2014.

(51) Int. Cl.
*F41H 3/02* (2006.01)

(52) U.S. Cl.
CPC ..... *F41H 3/02* (2013.01)

(58) Field of Classification Search
CPC ..... F41H 4/02; F41H 3/02
See application file for complete search history.

(56) References Cited

U.S. PATENT DOCUMENTS

| | | | | |
|---|---|---|---|---|
| 3,733,606 | A | 5/1973 | Johansson | |
| 4,064,305 | A | 12/1977 | Wallin | |
| 4,287,243 | A | 9/1981 | Nielsen | |
| 4,528,229 | A | 7/1985 | Gottlieb | |
| 4,529,633 | A * | 7/1985 | Karlsson | B32B 15/08 428/17 |
| 4,615,921 | A | 10/1986 | Johansson | |
| 4,621,012 | A | 11/1986 | Pusch | |
| 5,312,678 | A | 5/1994 | McCullough, Jr. et al. | |
| 5,348,789 | A * | 9/1994 | Hellwig | F41H 3/02 428/131 |
| 5,950,237 | A | 9/1999 | Micheron et al. | |
| 6,859,983 | B2 | 3/2005 | Curtis et al. | |
| 8,013,776 | B2 | 9/2011 | Child | |
| 8,030,228 | B2 | 10/2011 | Flavin | |
| 8,077,071 | B2 * | 12/2011 | Cincotti | F41H 3/00 342/3 |
| 8,203,129 | B2 | 6/2012 | Slinkard et al. | |
| 8,340,358 | B2 | 12/2012 | Cincotti et al. | |
| 8,495,946 | B2 | 7/2013 | Jackson et al. | |
| 8,779,964 | B2 | 7/2014 | Kelsey et al. | |
| 8,846,179 | B2 | 9/2014 | Saucedo | |
| 2004/0213982 | A1 | 10/2004 | Touzov | |
| 2006/0240064 | A9 | 10/2006 | Hunter et al. | |
| 2007/0202295 | A1 | 8/2007 | Kamiya | |
| 2009/0317596 | A1 | 12/2009 | Flavin | |
| 2011/0194846 | A1 | 8/2011 | Wang et al. | |
| 2014/0255203 | A1 | 9/2014 | Roby et al. | |

FOREIGN PATENT DOCUMENTS

WO WO2009124117 * 10/2009

OTHER PUBLICATIONS

International Search Report and Written Opinion for PCT Application No. PCT/2016/065235, dated Feb. 23, 2017.

* cited by examiner

*Primary Examiner* — Cephia D Toomer
(74) *Attorney, Agent, or Firm* — Schmeiser, Olsen & Watts, LLP

(57) ABSTRACT

A device for hiding or camouflaging an object or group of objects is disclosed. The device uses a knitted mesh of fibers which is subsequently deformed to provide further camouflage properties. Methods of using and making the device are also provided.

20 Claims, 4 Drawing Sheets

MULTI-SPECTRAL CAMOUFLAGE DEVICE AND METHOD

CROSS-REFERENCE TO RELATED APPLICATION(S)

This application claims priority to U.S. Provisional Patent Application Ser. No. 62/090,574, filed Dec. 11, 2014, the contents of which are hereby incorporated by reference in its entirety.

FIELD OF THE TECHNOLOGY

The subject matter disclosed herein relates generally to camouflaging an object or group of objects from detection as well as methods of using and making the same. More particularly, the following provides a device with enhanced anti-detection properties against visual, radar, and heat-sensitive detection means.

BACKGROUND

Camouflage nets are used, particularly by military forces, to reduce the possibility of detection by optical, electromagnetic, thermal, and radar detection systems. Equipment and personnel can thus be made to blend in with their surroundings and be hidden from enemy forces.

Camouflage nets already in use suffer from various defects, such as insufficient protection from radar and thermal imaging as well as visual detection, snagging and ripping of the netting material, and overall deterioration of the camouflage net device.

Further, most nets are of two types: so-called three-dimensional and two-dimensional designs. Three-dimensional nets typically comprise a base net to which additional garnish is attached. The garnish is often a coated fabric which possesses visual and infrared properties which may match the expected terrain in which the net is to be used. The garnish may be cut or otherwise varied to enhance the three-dimensional appearance and may be further coated with thermal and radar silhouette reducing materials. While these garnishes provide enhanced camouflage protection, they are often subject to ripping and tearing during use; reduce transportability by adding additional, often cumbersome, weight to the device; and reduce convenience of set up and deployment.

Two-dimensional nets, on the other hand, have a closer woven or knitted pattern with no attached garnish. Instead of the garnish, radar absorbing or reflecting properties may be incorporated into the yarn itself or applied as a coating. Additional radar silhouette reduction may be achieved by interweaving metal filaments into the mesh structure; however, the amount of metal filament that can be introduced into yarn mesh is typically insufficient to adequately prevent detection by modern radar equipment. Further, these two-dimensional nets are often not as effective at providing visual camouflage or protecting against infrared detection.

Thus, an effective, durable, conveniently transportable, and quickly deployable multi-spectral camouflage device would be well received in the art.

SUMMARY

According to one aspect, a camouflage device comprises a mesh of fibers, in which at least some of the fibers are capable of providing at least one of absorbing, reflecting, scattering, or transmitting electromagnetic energy; wherein the mesh of fibers is deformed by at least one of mechanical or heat means, such that individual fibers of the mesh take on a shape that is at least one of substantially irregular, rippled, or wavy.

According to a second aspect, a method for camouflaging an object comprises providing a camouflage net made of a mesh of fibers, wherein at least some of the fibers are capable of providing at least one of absorbing, reflecting, scattering, or transmitting electromagnetic energy, further wherein the mesh of fibers is deformed by at least one of mechanical or heat means, such that individual fibers of the mesh take on a shape that is at least one of substantially irregular, rippled, or wavy; and situating the camouflage net between the object and a detection source, wherein the detection source uses at least one of an optical, electro-optical, electromagnetic, radar, or thermal detection means.

According to a third aspect, a method of making a camouflage device comprises providing a mesh of knitted fabric, wherein the mesh of knitted fabric is substantially one single layer; and deforming the mesh of knitted fabric by at least one of mechanical and thermal means to alter an electromagnetic property of the mesh of knitted fabric.

BRIEF DESCRIPTION OF THE DRAWINGS

The subject matter which is regarded as the invention is particularly pointed out and distinctly claimed in the claims included at the conclusion of this specification. The foregoing and other features and advantages of the invention are apparent from the following detailed description taken in conjunction with the accompanying drawings in which:

DETAILED DESCRIPTION

Figure 1:
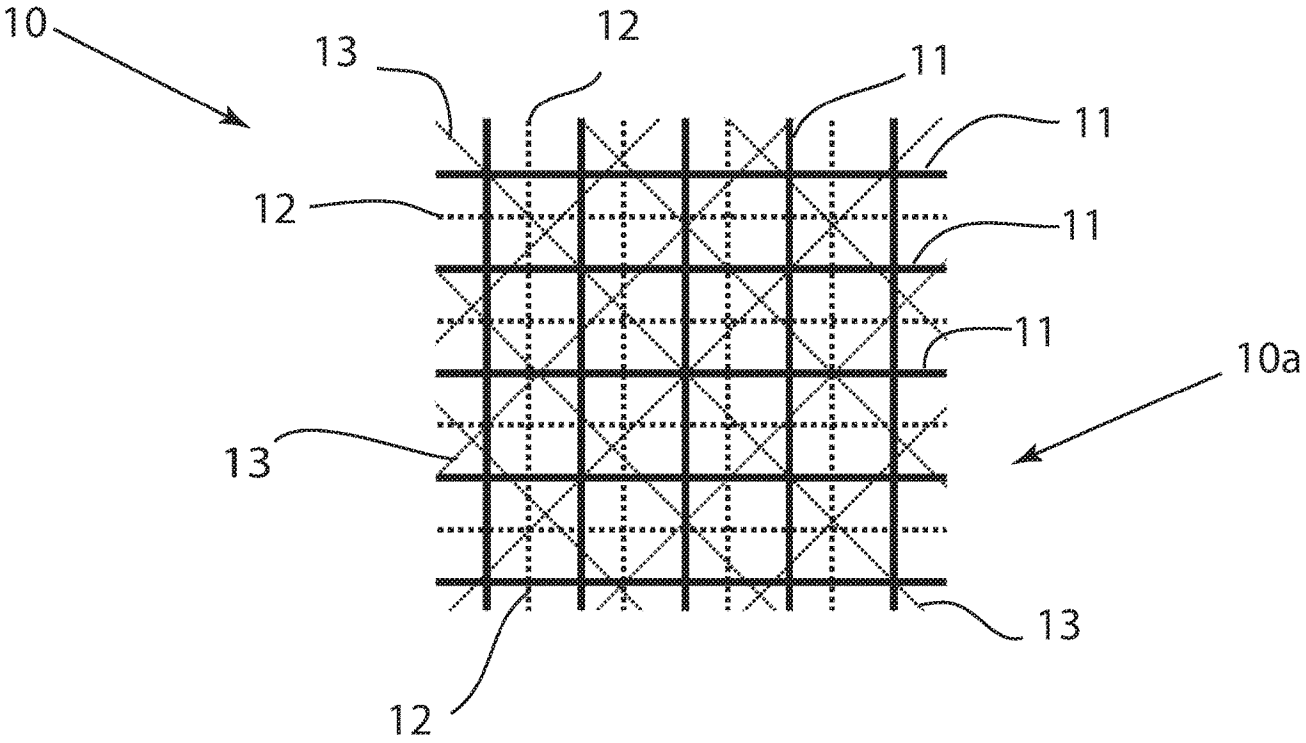
FIG. 1 depicts a top perspective view of a portion of a camouflage device in accordance with one embodiment.

Although certain embodiments of the present invention will be shown and described in detail, it should be understood that various changes and modifications may be made without departing from the scope of the appended claims. The scope of the present invention will in no way be limited to the number of constituting components, the materials thereof, the devices thereof, the relative arrangement thereof, etc.; these are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Disclosed is a multi-spectral camouflage device 10 which has electromagnetic screening properties to protect equipment, vehicles, structures, other objects, and personnel from detection by modern detection equipment and methods. For example, the device 10 may provide defense against detection by electro-optic, electromagnetic, thermal, and radar means, in addition to providing visual camouflage for the covered object or objects.

The camouflage device 10 may provide visual camouflage for the covered object. As will be discussed in further detail, this may be accomplished by providing an irregularly patterned mesh 10*a* with colors approximating the colors of the surrounding environment. The mesh 10*a* may also be formed to have a textured or rippled surface to further mimic the random structure and appearance of a natural environment. Thus, the camouflage device 10 may blend in with its surroundings to both a casual observer and an individual conducting a visual search.

The camouflage device 10 may also provide an electromagnetic screen—that is, it may provide protection against detection by electro-optic, electromagnetic, thermal, infrared, and/or radar detection systems. As will be discussed in further detail, this may be accomplished by a mesh 10*a* of certain fibers, combined with three-dimensional texturing and various optional coatings.

Referring now to FIG. 1, a portion of a camouflage device 10 is shown according to one embodiment. FIG. 1 depicts, according to one embodiment, a visual representation of what the mesh 10*a* may look like when viewed by a user without any magnification or assistance. The device 10 is comprised of a mesh 10*a* of interconnected fibers. In one embodiment, the interconnected fibers of the mesh 10*a* are interconnected by knitting. In one embodiment, the mesh of interconnected fibers contains multiple primary fibers 11.

In one embodiment, the primary fibers 11 are knitted together to form the mesh 10*a*. In a further embodiment, the primary fibers 11 are knitted together to form a mesh 10*a* which is substantially one single layer of fabric mesh 10*a*. In one embodiment, substantially one single layer may mean that the mesh 10*a* does not include any garnish or second layer of material to increase the camouflage properties. In another embodiment, it may mean simply that the primary fibers 11 are knitted together to form one fabric, rather than forming multiple fabrics or fabric layers which are later attached to each other. In another embodiment, it may mean that the primary fibers 11 do not double back on themselves, i.e., there is no location of the mesh 10*a* wherein the same primary fiber 11 is situated on itself to form a second layer. In a further embodiment, like any knitted fabric or material, there may be locations of the mesh 10 wherein two or more primary fibers 11 overlap (this is inherent in the knitting process); such an area may still comprise substantially one single layer of fabric or material.

The mesh 10*a* of substantially one single layer may include a camouflage pattern as described below. In yet a further embodiment, the mesh 10*a* of a substantially single layer may be double-sided, having a camouflage pattern on each side of the substantially single layer mesh 10*a*. In one embodiment, the camouflage pattern may be the same or substantially similar on each side of the substantially single layer mesh 10*a*. In an alternative embodiment, different camouflage patterns may be included on different sides of the substantially single layer mesh 10*a*.

Embodiments of the primary fibers 11 may be arranged so that they are each one of substantially parallel and substantially perpendicular to every other primary fiber 11 in the final knitted mesh 10*a*. The primary fibers 11 may be comprised of a material which offers effective reflection of, absorption of, scattering of, and/or other interaction with electromagnetic waves. For example, in one embodiment, the primary fibers 11 may be comprised of carbon fiber roving. In another embodiment, the primary fibers 11 may be carbon fiber nanotube material. Other similar materials may also be used.

Carbon fiber roving may mean any type of carbon fiber. One type of carbon fiber used may include a continuous tow formed of multiple individual carbon filaments. A coating may be used around the multiple individual carbon filaments. Carbon filaments within the tow may be of any suitable size. Further, the carbon fiber may be turbostratic or graphitic or a hybrid of these structures. Depending on the type and structure chosen, the carbon fiber may have varying tensile strength, varying stiffness ratings (Young's modulus), varying levels of thermal conductivity, varying electrical properties, optical properties, or hardness.

Similarly, various carbon fiber nanotube materials may be used, and the nanotubes may be a metal or a semiconductor. Either single-walled carbon nanotubes or multi-walled carbon nanotubes may be used. Armchair, zigzag, or chiral single-walled carbon nanotubes may be used. Similarly, multi-walled carbon nanotubes of the Russian Doll model or the Parchment model may be used. Alternatively, torus or nanobud features may be included in the nanotube materials. The various embodiments of carbon fiber nanotube material may also have varying properties, such as stiffness or Young's modulus, tensile strength, hardness, electrical properties, optical properties, or thermal conductivity.

Various spatial densities of primary fibers 11 may be used. The term spatial density refers to the spacing of the primary fibers 11 or to the amount of primary fibers 11 present within a specific area of the mesh 10*a* of the camouflage device 10. For example, an embodiment of the camouflage device 10 may contain five primary fibers 11 arranged in a substantially parallel direction per inch of the mesh 10*a* of the camouflage device 10. Another embodiment may contain ten primary fibers 11 per inch or fifteen primary fibers 11 per inch. Alternatively, an embodiment may contain fewer than five primary fibers 11 per inch, more than fifteen primary fibers 11 per inch, or any suitable amount of primary fibers 11 per inch that is desired. The spatial density may also be measured by the number of primary fibers 11 within a given square inch—this measurement would necessarily include both substantially parallel and substantially perpendicular primary fibers 11—i.e., any primary fibers 11 regardless of the direction or orientation. The spatial density (whether the spacing or the amount of fiber within a specific area) may be varied for whatever material is used for the primary fibers 11.

In addition to varying the spatial density of the primary fibers 11, embodiments of the camouflage device 10 may also include primary fibers 11 of varying fiber weight. The term fiber weight may mean either the linear density (weight per unit length) or the number of filaments per yarn count. For example, the primary fibers 11 may be made of carbon fiber rovings with various weights per square yard (or any other measurement of length or area) such as seven ounces per yard, eleven ounces per yard, or any other weight per yard. Similarly, the primary fibers 11 may be made of various grades of carbon fiber based upon filament count such as those containing 1,000, 3,000, 6,000, 12,000, 24,000, 50,000 or any other number of individual carbon fiber filaments. The fiber weight (whether linear density or the number of filaments per yarn count) may be varied for other materials in the same manner as for carbon fiber as has been described. Thus, it will be understood that increased fiber weight may mean the use of a heavier fiber with the same width or a wider fiber (increased surface area as viewed from the orientation of FIG. 1) as the primary fibers 11. Similarly, decreased fiber weight may mean that the primary fibers 11 are narrower (decreased surface area as view from the orientation of FIG. 1) or that a lighter fiber is used even if the width remains the same.

In one embodiment, a plurality of first support fibers 12 may also be provided. The first support fibers 12 may be orientated in a similar pattern as the primary fibers 11. For example, the first support fibers 12 may be arranged so that they each appear to be one of substantially parallel and substantially perpendicular to every primary fiber 11, when viewed as depicted in FIG. 1. These first support fibers 12 may thus appear be one of substantially parallel and substantially perpendicular to every primary fiber 11 as well as every other first support fiber 12 when viewed as depicted in FIG. 1.

In one embodiment, the primary fibers 11 and the first support fibers 12 are knitted together to form a mesh 10*a* of substantially one single layer, as has been previously described. In one embodiment, substantially one single layer may mean that the mesh 10*a* does not include any garnish to increase the camouflage properties. In another embodiment, it may mean that the primary fibers 11 and the first support fibers 12 are knitted together to form one fabric, rather than forming two fabrics or fabric layers which are subsequently attached to each other.

The first support fibers 12 may be made of any suitable material. In one embodiment a type of polyester, a type of polyamide, or a similar material may be used. Alternatively, the first support fibers 12 may be of a mixture or blend of any of these materials. Still further, the first support fibers 12 may be of the same material as the primary fibers 11. The first support fibers 12 may thus also have varying stiffness or Young's modulus, tensile strength, hardness, electrical properties, optical properties, or thermal conductivity.

A plurality of second support fibers 13 may also be provided. The second support fibers 13 may be orientated in a similar pattern as the primary fibers 11 and the first support fibers 12, i.e., they may also appear to be one of substantially parallel and perpendicular to the primary fibers 11 and the first support fibers 12 when viewed according to the embodiment of FIG. 1. In one embodiment, the second support fibers 13 may be orientated such that they appear to be substantially parallel or substantially perpendicular to every other second support fiber 13 but are at a substantially forty-five degree angle to the primary fibers 11 and the first support fibers 12. Other angles may be also be used as desired.

The second support fibers 13 may also be made of any suitable material. In one embodiment, the second support fibers 13 may be of the same material as the first support fibers 12 or the same material as the primary fibers 11. The first support fibers 12 may thus also have varying stiffness or Young's modulus, tensile strength, hardness, electrical properties, optical properties, or thermal conductivity.

In one embodiment, the primary fibers 11, the first support fibers 12, and the second support fibers 13 are knitted together to form a substantially single layer mesh 10*a*, as has been previously described. In one embodiment, substantially one single layer may mean that the mesh 10*a* does not include any garnish to increase the camouflage properties. In another embodiment, it may mean that the primary fibers 11, the first support fibers 12, and the second support fibers 13 are knitted together to form one fabric, rather than forming multiple fabrics or multiple fabric layers which are subsequently attached to each other.

In a further embodiment, additional fibers may be included as desired, such as a third support fiber, or another type of fiber. In yet an additional embodiment, the fibers, regardless of the amount or designation, may be knitted to form the mesh 10*a* as has been described above. Further, in an additional embodiment, the fibers, regardless of the amount or designation, may be knitted to form a mesh 10*a* which is substantially one single layer. In one embodiment, substantially one single layer may mean that the mesh 10*a* does not include any garnish to increase the camouflage properties. In another embodiment, it may mean that the primary fibers 11, the first support fibers 12, the second support fibers 13, and any additional fibers are knitted together to form one fabric, rather than forming multiple fabrics or multiple fabric layers which are subsequently attached to each other.

In one embodiment, both the first support fibers 12 and the second support fibers 13, and any further fibers which may be used, may be included in various spatial densities as described above regarding the primary fibers 11. Thus the spatial densities of each type of fiber may be different in various embodiments of the mesh 10*a* of the camouflage device 10.

Similarly, various fiber weights of the first support fibers 12 and the second support fibers 13 may be used as described above regarding the primary fibers 11. Thus the fiber weights of each type of fiber may be different in various embodiments of the mesh 10*a* of the camouflage device 10.

The inclusion of either first support fibers 12, second support fibers 13, or both, may provide various benefits. Similarly, the inclusion of any additional fibers may have benefits. Either or both of the first support fibers 12 and the second support fibers 13 may provide support for the primary fibers 11 or serve to hold the primary fibers 11 in place within the knitted mesh 10*a*. Further, as discussed in more detail below, the first support fibers 12 and/or second support fibers 13 may provide further surface area in the substantially single-layered mesh 10*a* for the acceptance of paints, dyes, pigments, images, patterns, and other means of visual camouflage; provide further surface area for the acceptance of coatings and chemical treatments which may enhance protection against electro-optic, electromagnetic, thermal, infrared, and/or radar detection; provide tensile strength and elastic capabilities to the substantially single-layered mesh 10*a*; and/or ensure durability of the mesh 10*a*. Additionally, in one embodiment, the first support fibers 12 and/or the second support fibers 13 may be more elastic than the primary fibers 11, particularly if the primary fibers 11 are of carbon fiber or carbon nanotubes. In one embodiment, the first support fibers 12 and/or the second support fibers 13 may be useful in providing and maintaining a three-dimensional, textured structure of the single-layered mesh 10*a* of the camouflage device 10.

As has been described, in one embodiment, the knitted mesh 10*a* is comprised of one single fabric, i.e., is substantially one single layer of fabric or material. A camouflage device 10 which has one single layer of fabric may exhibit certain camouflage properties, especially as relates to electromagnetic detection means, while a textured or three-dimensional camouflage device 10 may exhibit different or altered camouflage properties. Thus, for many purposes a textured or three-dimensional camouflage device 10 may be preferred. However, textured and three-dimensional camouflage devices have inherent drawbacks such as those discussed in the background. Therefore, in one embodiment, the mesh 10*a* may be deformed to provide additional camouflage properties, as is described below.

In one embodiment, the arrangement of primary fibers 11, first support fibers 12, and second support fibers 13 (as well as any other fibers chosen) is substantially regular across the entire surface of the substantially single-layered mesh 10*a* of device 10. For example, while distances between any fibers may not be exact or precise, the fibers may be provided at substantially regular intervals in order to ensure that uniform protection is generated by the entire device 10 across the entire substantially single-layered mesh 10*a* and that no portion offers inferior protection. While more irregular intervals may be used, it may then become necessary to take other precautions to ensure that the entire surface of the mesh 10*a* of the camouflage device 10 provides satisfactory camouflage protection for both visual and non-visual detection means.

The substantially single-layered mesh 10*a* of interconnected, knitted fibers described above may result in a substantially flat or substantially two-dimensional product, in one embodiment. While a substantially flat or two-dimensional camouflage device 10 may be satisfactory for certain applications, inclusion of three-dimensional texturing of the mesh 10*a* may enhance protection against visual and/or electromagnetic detection methods. Three-dimensional texturing may provide a more realistic image for visual camouflage and may further increase the tendency for the mesh to blend in with its surroundings. Similarly, the addition of three-dimensional texturing may enhance protection against non-visual detection by altering the capability of the camouflage device 10 to reflect, scatter, absorb, transmit, or otherwise interact with electromagnetic energy. The three-dimensional texturing may also aid in cooling the camouflage device 10 and preventing the buildup of excess heat.

In one embodiment, three-dimensional texturing may be added to the substantially single-layered mesh 10*a* of interconnected, knitted fibers by one or both of the following: thermal and mechanical deformation. For example, in one embodiment, a mixture of mechanical stress and heat stress processes are used to form the structure of the substantially single-layered mesh 10*a* of knitted fibers. For example, in one embodiment, the mesh 10*a* may be mechanically deformed by pressing, stamping, twisting, stretching, compressing, folding, shearing, other forms of pressure or force, or a combination thereof. In one embodiment, thermal deformation may include the application of heat to the mesh. In yet a further embodiment, thermal deformation may be accomplished by means of autoclave heat setting, steamatic process, power-heat-set means, SUPERBA TVP process, other means, or a combination thereof. The application of heat may be varied depending on the material(s) used in the mesh 10*a*, as well as the level of deformation preferred.

Various levels of deformation may be used. For example, in one embodiment, deformation height may range from 0 millimeters to 8 millimeters. In one embodiment, the deformation may be substantially consistent throughout the mesh 10*a*; for example, every portion of the mesh which is deformed may be deformed to the same level. In another embodiment, the deformation may vary at different points of the mesh 10*a*.

In a still further embodiment, the separation or distance between the deformed portions of the mesh 10*a* may be varied. For example, the distance between peaks and troughs may be varied. In one embodiment, the distance may be consistent throughout the mesh 10*a*; for example, the distance from peak to trough may be substantially identical throughout the mesh 10*a*. In an alternative embodiment, the distance may vary at different points of the mesh 10*a*.

Both the height of deformation and the distance between the deformed points may be used to customize the camouflage properties of the mesh 10*a* and the camouflage device 10 as is described in more detail below.

Figure 2:
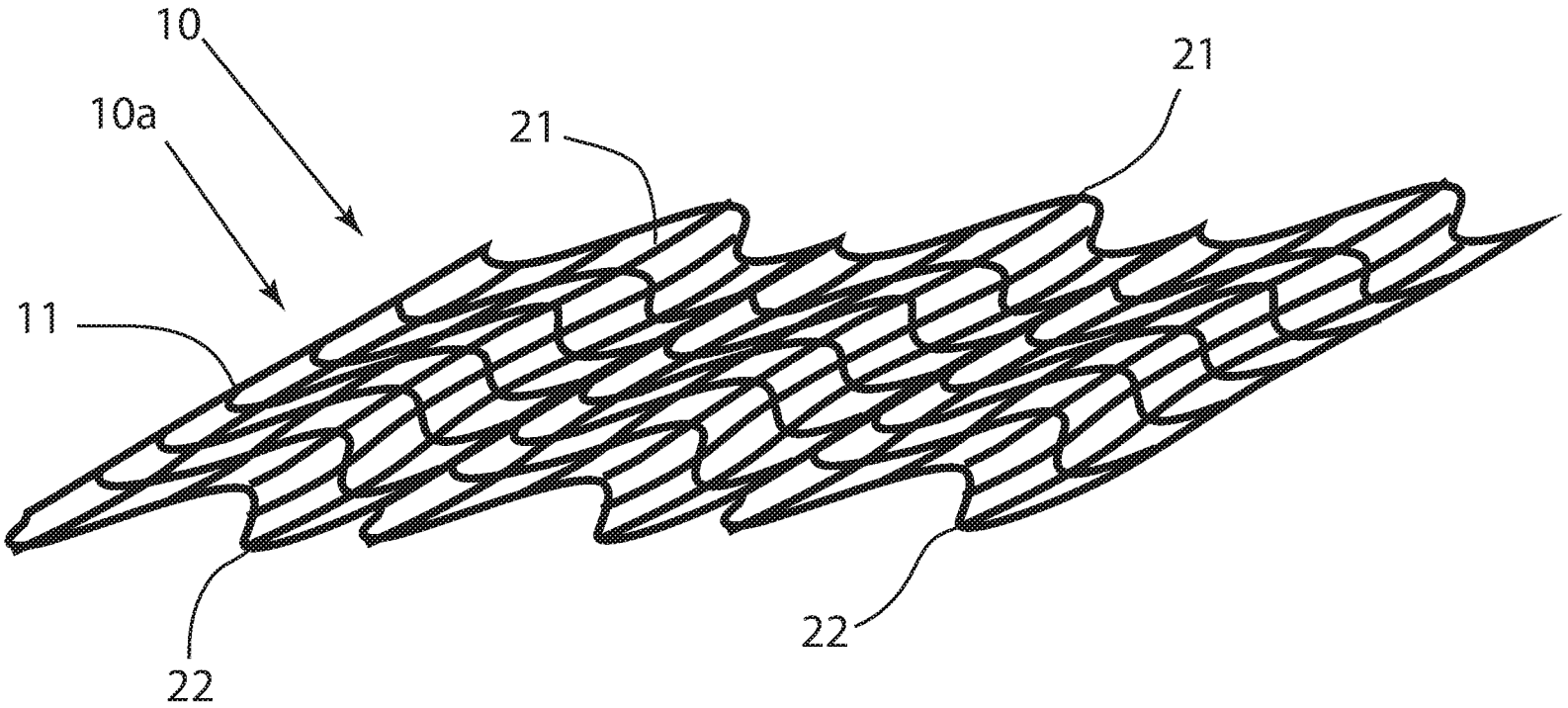
FIG. 2 depicts a side perspective view of a portion of a camouflage device in accordance with one embodiment.
Figure 3:
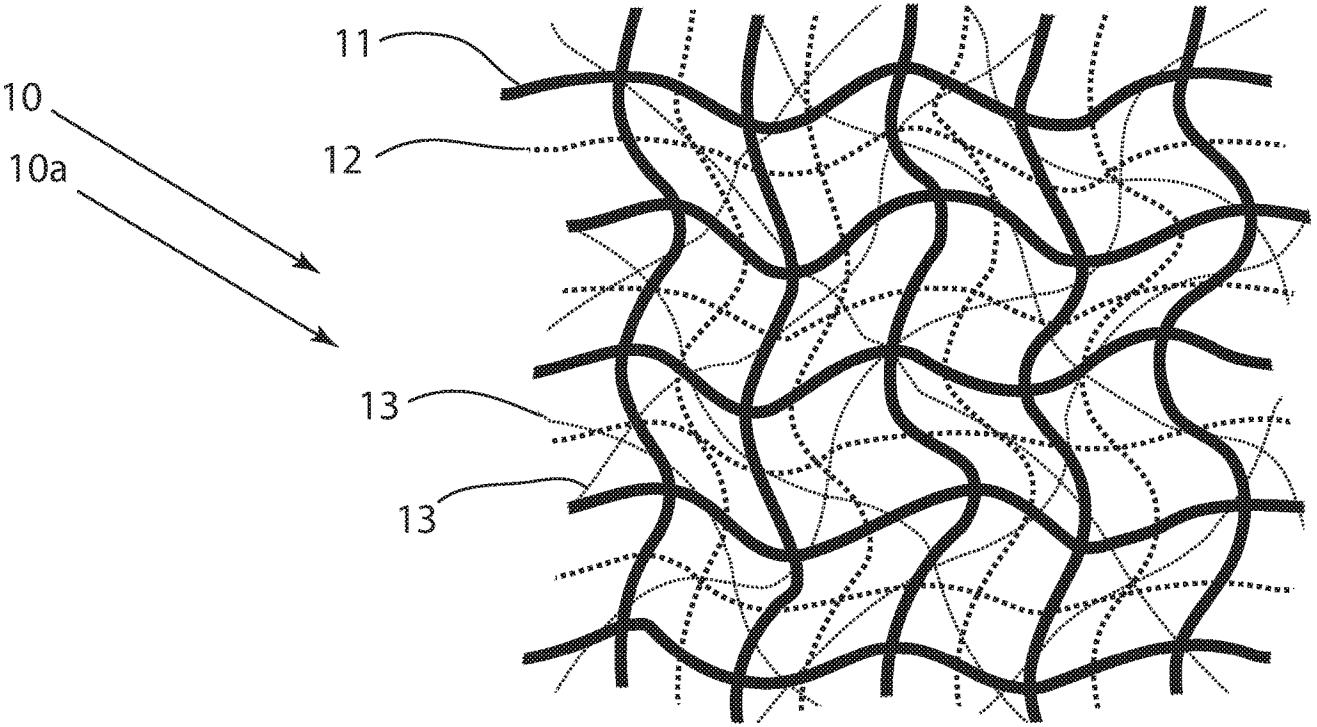
FIG. 3 depicts a top perspective view of a portion of a camouflage device in accordance with one embodiment.

According to one embodiment, the mesh 10*a* of the camouflage device 10 may take on a rippled, undulating shape as shown in FIGS. 2 and 3. (It should be understood that these Figures are used for the purposes of depiction only, and that they may not accurately portray the actual knitted pattern of the mesh 10*a* of fibers.) As shown more specifically in FIG. 3, the deformation may be more random and irregular in one embodiment. As shown in these figures, in one embodiment, the primary fibers 11 may form repeating undulations, ripples, or waves, with crests 21 and troughs 22, within the knitted pattern of the substantially single-layered mesh 10*a*. The first support fibers 12 and the second support fibers 13 of the substantially single-layered mesh 10*a* may also have similar three-dimensional structures in one embodiment due to the deformation process. In an additional embodiment, the first support fibers 12 and/or the second support fibers 13 may be more susceptible to deformation than the primary fibers 11 based upon the materials used, thus they may resist deformation less and also have a reduced tendency to retain to their original orientation. Thus, according to one embodiment, the first support fibers 12 and/or the second support fibers 13 may serve to hold the primary fibers 11 in a deformed, textured, three-dimensional shape with more success than if only the primary fibers 11 were used in the knitted mesh 10*a*. In an alternative embodiment, the primary fibers 11 may be more susceptible to deformation than one of or both of the first support fibers 12 and the second support fibers 13. Therefore, in different embodiments, different fibers may have more elasticity or a greater ability to retain their shape under stress, resulting in deformation of only certain fibers in the single-layered mesh 10*a*.

In one embodiment, the deformed single-layered knitted mesh 10*a* may provide advanced camouflage properties, portability, durability, and ease of use over other camouflage systems which utilize multiple different layers of fabric or material. Similarly, the deformed single-layered knitted mesh 10*a* may provide advanced camouflage properties, portability, durability, and ease of use over other camouflage systems which utilize deformed products, as these other systems are typically comprised of rigid materials which cannot be used similarly to the mesh 10*a* or camouflage net of the present application.

The three-dimensional texturing of the knitted mesh 10*a* by thermal and/or mechanical deformation may directly impact one or more electromagnetic screening properties of the camouflage device 10. For example, according to one embodiment, a highly deformed, highly three-dimensional mesh 10*a* of substantially one single-layer will increase the random reflection and scattering of electromagnetic waves by the camouflage device 10. This deformation may thus decrease the amount of electromagnetic radiation returned to a radar receiver or other detection device, minimizing a radar cross section and/or electromagnetic profile of the camouflage device 10 and the concealed object. Conversely, in a further embodiment, a camouflage device 10 comprising a single layer knitted mesh 10*a* with fewer deformations and a more two-dimensional type structure may have decreased random reflection and scattering and thus have a greater radar cross section or electromagnetic profile to be detected.

The three-dimensional texturing may also aid in cooling the camouflage device 10 and preventing accumulation of heat. In one embodiment, a highly deformed camouflage net 10 comprised of a single layer knitted mesh 10*a* may help distribute heat evenly across its surface and also have increased surface area for heat dissipation. Further, the mesh

10*a* may inherently allow for natural heating and cooling based upon the holes or spaces present in the camouflage net 10 in one embodiment.

Altering of the spatial density of the primary fibers 11 and/or their fiber weights may also directly impact one or more electromagnetic screening properties of the camouflage device 10. For example, in one embodiment, increasing the spatial density—including more fibers per inch—or increasing the fiber weight—whether by using a heavier fiber or by an increased fiber width—may increase absorption of the detecting energy wave's energy. The absorption of energy reduces the energy available to be returned to the electromagnetic wave's source, thereby decreasing the radar cross section or other electromagnetic profile of the mesh 10*a* of the camouflage device 10. Conversely, in a further embodiment, a decreased spatial density and/or a decreased fiber weight may result in less absorption of electromagnetic waves, increased return of electromagnetic waves to a detection device, and a greater radar cross section or electromagnetic profile.

Similarly, altering the spatial density and/or fiber weight of the first support fibers 12 and second support fibers 13 may also impact one or more electromagnetic screening properties of the mesh 10*a* of camouflage device 10. In one embodiment, the first support fibers 12 and/or the second support fibers 13 may also be capable of reflecting, absorbing, or otherwise interacting with electromagnetic waves. Thus, increasing their spatial density and/or fiber weight may affect the overall electromagnetic screening properties in much the same way as altering the same characteristics of the primary fibers 11.

Additionally or alternatively, changing the spatial density or fiber weight of any of the primary fibers 11, first support fibers 12, or second support fibers 13 or changing one or more mesh 10*a* features—such as layout, orientation, overall density, overall weight, relative proportions of the different fiber types, amount of space not occupied by any fiber, total size, total thickness, total density, etc., may alter one or more electromagnetic screening properties as well. For example, the reflection/scattering of the electromagnetic wave may be impacted as described above; similarly, the absorption capabilities may be changed. Further, according to one embodiment, the single layer knitted mesh 10*a* structure of the camouflage device allows at least a portion of an incident wave of electromagnetic energy to pass through—both through one or more materials of the mesh 10*a* and through the empty spaces in the mesh 10*a*. The portion of the electromagnetic wave allowed to pass through may reach the camouflaged object or another area under, behind, or within the camouflage device 10 in one embodiment. In an embodiment, it may then be absorbed by the camouflaged object, ground, or other features, reflected/scattered by the camouflaged object, ground, or other features, or may otherwise interact with the camouflaged object, ground, or other features. The reflected/scattered portion may be directed predominantly away from the source (such as an electromagnetic transmitter) in one embodiment, reducing the electromagnetic profile detected, or it may be reflected back toward the transmitter and/or receiver. Regardless of the direction of the wave reflected/scattered by the camouflaged object, in a further embodiment, the reflected/scattered wave may have to pass through the knitted mesh 10*a* of the camouflage device 10 a second time in order to reach the electromagnetic transmitter and/or receiver. Thus, the knitted mesh 10*a* of the camouflage device 10 will act upon this portion of the electromagnetic wave at least a second time resulting in further attenuation and scattering of the electromagnetic wave and a further reduced electromagnetic profile. It will be understood that, in at least one embodiment, some waves may undergo multiple incidences of reflection, scattering, or absorption by the mesh 10*a* of the camouflage device 10.

Changing one or more features of the substantially single layered knitted mesh 10*a*—such as layout, orientation, overall density, overall weight, relative proportions of the different fiber types, amount of space not occupied by any fiber, total size, total thickness, total density, etc., may also impact the thermal properties of the device in various embodiments. For example, in one embodiment, a more open knitting pattern of the mesh 10*a* may allow for better heat transfer between air inside the camouflage device 10 and outside air. In an alternative embodiment, a smaller mesh size may provide the capability of preventing heat from escaping or entering the camouflage device 10. Similarly, the varying types of fibers contemplated for the knitted mesh 10*a* may have differing thermal properties. For example, in one embodiment the fibers may have varying emissivity based upon the material used. The fibers may thus emit, transmit, reflect, absorb, conduct, or otherwise interact with infrared energy to different extents in varying embodiments.

In one embodiment, additional variation of the camouflage device 10 may be accomplished by the use of various coatings to one or more of the primary fibers 11, first support fibers 12, second support fibers 13, or to the single-layered knitted mesh 10*a* as a whole. In different embodiments, the coatings may be applied to the fibers before the mesh 10*a*, or may be applied to the mesh 10*a* whole, either before or after it is mechanically and/or thermally deformed. In one embodiment, the coatings may be paints, dyes, pigments, chemical treatments, or any suitable material. In yet a further embodiment, the coatings may serve to provide colors, images, patterns, etc., for visual camouflage of the camouflage device 10. The coatings may also serve to provide one or more additional electromagnetic properties for the mesh 10*a* of the camouflage device 10. For example, in one embodiment, the coating may be an electromagnetic energy-absorbing material, an electromagnetic energy-reflecting material, an electromagnetic energy-scattering material, or may be capable of interacting with electromagnetic radiation in other ways.

Due to creation of the mesh 10*a* from multiple types of fibers with varying spatial densities and fiber weights, the options of varying mesh 10*a* features, the variable deformation of the final mesh 10*a*, and the options of various coatings, the camouflage device 10 may be customizable to provide camouflage protection specifically adapted to any chosen environment. For example, any of the options for fiber type, spatial density, fiber weight, mesh features, and deformation level may be combined with as many of the other options of these qualities as is desired. Thus, an entirely unique mesh 10*a* and overall camouflage device 10 for any and all environments may be provided with relative ease.

In a further embodiment, a unique mesh 10*a* and camouflage device 10 may be tailored to meet not only a visual camouflage profile, but an electromagnetic camouflage profile as well. To accomplish this, an expected environmental background profile may be determined. The environmental background profile may take into account the type of terrain, expected vegetation features, and natural electromagnetic features of the area in which the camouflage device 10 will be used. The mesh 10*a* and camouflage device 10 may then be fabricated to substantially match the parameters selected in the environmental background profile.

A mesh 10*a* and camouflage device 10 tailored to a particular environmental background profile may have many advantages over other camouflage devices which merely absorb or scatter as much electromagnetic radiation as possible. In one embodiment, the mesh 10*a* and camouflage device 10 may be designed to mimic the natural level of reflection, scattering, and absorption of the natural environment. Unlike the present device, some competing camouflage systems may maximize absorption and/or reflection/scattering—resulting in an area that does not provide any electromagnetic profile at all—a so-called "black hole" to radar and other detection devices. Such a strategy may be sufficient to camouflage some objects from certain detection means; however, more advanced detection systems may recognize this anomaly. Similarly, providing an absorption or reflection rate that is inconsistent with the environmental background profile may interact with electromagnetic detection means in a highly effective way, but thus in effect reduce the protection provided. For these reasons, it may be important for the mesh 10*a* and the camouflage device 10 to actually reflect some electromagnetic waves back to a detection device in order to provide effective camouflage.

For example, in one embodiment, a desert environment may naturally have limited terrain features, an overall lack of vegetation, and an expected minimum electromagnetic profile as dry sand does not reflect electromagnetic waves back to a transmitter/receiver very well—it instead has high absorption and scattering properties. Thus, in one embodiment, a mesh 10*a* and camouflage device 10 designed for this environment may have a high deformation to facilitate a high level of random scattering of any electromagnetic waves. Further, the camouflage device 10 may include a high spatial density of primary fibers 11 to increase absorption as well. In an additional embodiment, if desired, coatings may be provided to further enhance the random scattering of electromagnetic radiation, increase absorption, to match the color of the surrounding sand, or to accomplish all three of these options.

Alternatively, a wetlands area may have an abundance of vegetation and an electromagnetic profile which does not include much random scattering. Thus, in one embodiment, a mesh 10*a* and camouflage device 10 designed for this environment may be significantly less distorted while maintaining a high spatial density of primary fibers 11. This camouflage device 10 may thus minimize random scattering of any electromagnetic wave while ensuring adequate absorption in order to match the environmental background profile. Coatings for this camouflage device 10 may provide a green, brown, or vegetal color scheme and may alter one or more electromagnetic properties of the camouflage device 10 to further approximate the chosen environmental background profile.

Figure 4:
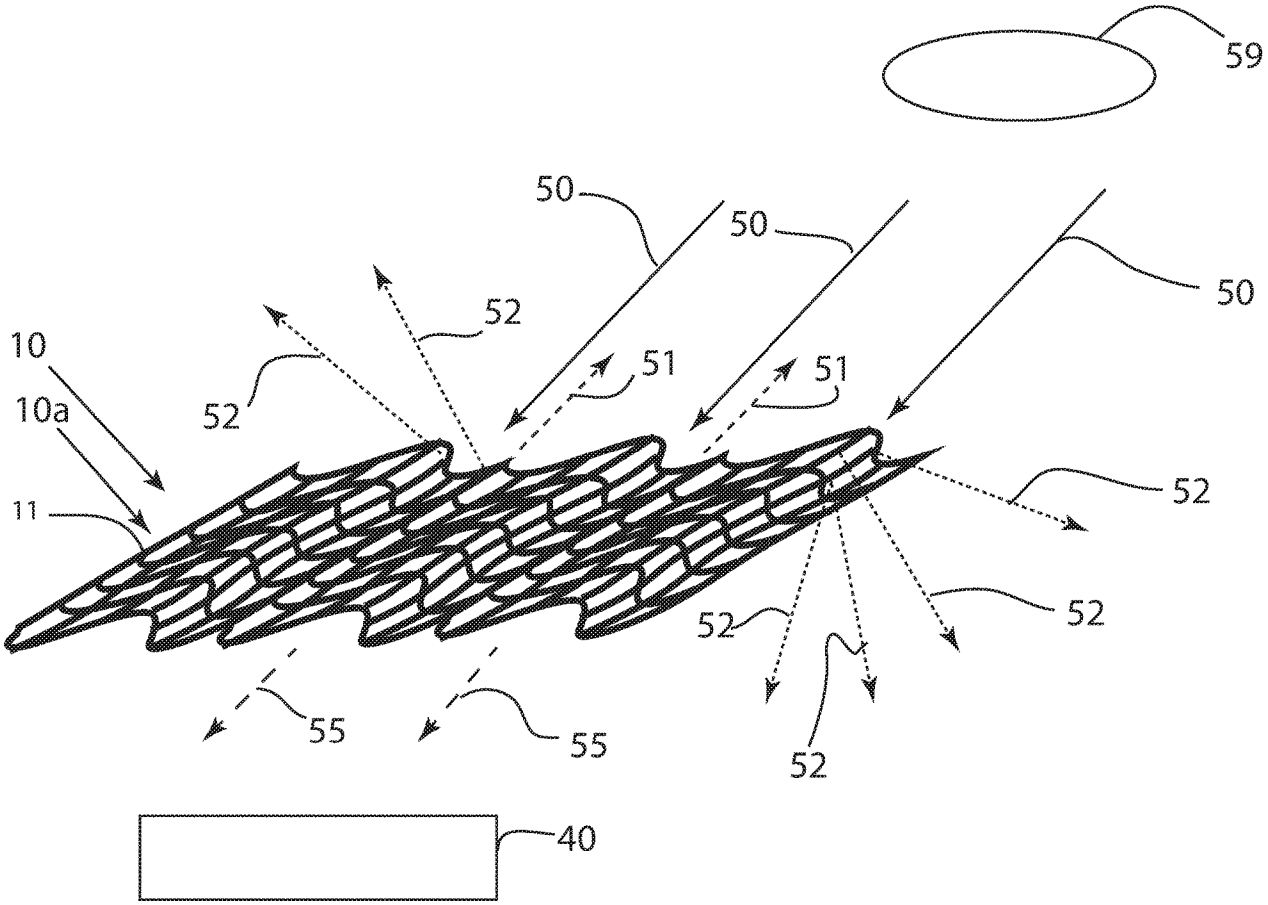
FIG. 4 depicts a perspective view of a portion of a camouflage device in use in accordance with one embodiment.

FIG. 4 depicts a schematic representation of a portion of a camouflage device 10 (comprising a mesh 10*a*) in use protecting a covered object 40. (This figure only depicts the primary fibers 11 in order to show a level of deformation of the mesh 10*a*. Either first support fibers, second support fibers, both, or additional fibers may also be included in further embodiments.) As shown, the camouflage device 10 is located between the covered object 40 and a form of electromagnetic radiation, such as radar, thermal imaging, or the like, advancing along the lines shown by vectors 50 from an origin 59. In some embodiments, at least a small portion of the radiation 50 maybe reflected by the camouflage device 10 and thus may proceed in a course substantially directed toward the origin 59, as is shown by vectors 51. Depending on the embodiment and customization of the particular embodiment of the camouflage device 10 (particularly the material chosen for the primary fibers 11, the spatial density and fiber weight of these primary fibers 11, and any coatings applied) a large amount of the electromagnetic radiation may be absorbed by the camouflage device 10. Further, depending on those factors chosen and particularly on the level of deformation chosen for the embodiment of the camouflage device 10, the electromagnetic radiation may be scattered in a wide variety of random angles as shown by vectors 52. Finally, depending on the combination of the above factors, as well as the size of the knitting pattern chose for the mesh 10*a*, some of the electromagnetic radiation may proceed through the camouflage device 10 as shown by vectors 55, where it may interact with the covered object 40 or other objects. Some of this electromagnetic radiation may be absorbed by the covered object or scattered into the ground or other feature. A portion of the radiation 55 shown passing through the camouflage device 10 may be scattered from the covered object 40 in a way that requires it to pass through the camouflage device 10 a second time, or may be reflected back toward the origin 59 which would also require it to pass through the camouflage device 10 again. The second pass may give a further opportunity for the camouflage net to absorb, scatter, or otherwise interact with the electromagnetic radiation, attenuating and decreasing any radar cross section or electromagnetic profile.

The mesh 10*a* and device 10 described above may be used in a variety of temperatures. In one embodiment, the mesh 10*a* and device 10 may be usable in temperatures as low as negative 35 degrees Celsius without any negative impact on the camouflage or other mechanical properties. In a further embodiment, the mesh 10*a* and device 10 may be usable in temperatures as high as 70 degrees Celsius without any negative impact on the camouflage or other mechanical properties.

In yet a further embodiment, the mesh 10*a* and device 10 described above may retain its camouflage properties even when wet. This is an advance over many of the camouflage devices known in the prior art, which tend to become highly reflective when wet (such as when they are rained on) resulting in decreased camouflage properties against radar and other detection means.

The deformed structure of the single layer knitted mesh 10*a*, as described above, also maintains its camouflage properties against thermal and radar detection even when the detection means (or source of the electromagnetic energy) is situated at a variety of angles. For example, in one embodiment, the single layer knitted mesh 10*a* may exhibit certain camouflage properties against thermal and radar detection when the electromagnetic energy generated from the detection means impacts the mesh 10*a* straight on, i.e., completely perpendicular to the specific cross section of the mesh 10*a* or a 0 degree angle of incidence. Unlike other camouflage systems, in which the camouflage properties may vastly change as the value of the angle of incidence increases, in one embodiment, the mesh 10*a* may exhibit substantially similar camouflage properties against thermal and radar detection when the angle of incidence varies by as much as ±120 degrees due to the deformed structure of the single-layered knitted mesh 10*a*.

What is claimed is:

1. A camouflage device, consisting of:

a substantially single layer mesh of fibers, wherein at least some of the fibers are capable of providing at least one of absorbing, reflecting, scattering, and transmitting electromagnetic energy including radar;

wherein three-dimensional texturing is added to the mesh of fibers by fixedly deforming the mesh of fibers by at least one of mechanical and heat means, such that individual fibers of the mesh of fibers take on a shape that is at least one of substantially irregular, rippled, and wavy.

2. The device of claim 1, wherein the mesh of fibers is comprised of fibers knitted together.

3. The device of claim 1, wherein at least some of the fibers are a carbon fiber material.

4. The device of claim 1, wherein at least some of the fibers are a carbon fiber nanotube material.

5. The device of claim 1, wherein at least some of the fibers are configured to be one of substantially parallel and substantially perpendicular to each other.

6. The device of claim 1, wherein a coating is applied to at least some of the fibers.

7. The device of claim 1, wherein a coating is applied to the mesh of fibers as a whole.

8. The device of claim 1, wherein the mesh of fibers comprises at least a plurality of primary fibers and a plurality of secondary fibers.

9. The device of claim 8, wherein the plurality of primary fibers are comprised of a carbon fiber material and the plurality of secondary fibers are a second material.

10. The device of claim 8, further wherein:

the plurality of primary fibers and the plurality of secondary fibers are knitted together such that the mesh of fibers forms one fabric.

11. The device of claim 8, further wherein:

each primary fiber of the plurality of primary fibers is one of substantially parallel and substantially perpendicular to every other primary fiber; and each secondary fiber of the plurality of secondary fibers is one of substantially parallel and substantially perpendicular to every other second fiber.

12. The device of claim 11, further wherein the plurality of secondary fibers is offset by substantially 45 degrees from the plurality of primary fibers.

13. A method of camouflaging an object, comprising:

providing a camouflage net consisting of a substantially single layer, wherein the substantially single layer comprises a knitted mesh of fibers, wherein at least some of the fibers are capable of providing at least one of absorbing, reflecting, scattering, and transmitting electromagnetic energy including radar, further wherein the single layer camouflage net is fixedly deformed by at least one of mechanical or heat means, such that individual fibers of the mesh of fibers takes on a shape that is at least one of substantially irregular, rippled, and wavy; and situating the camouflage net between the object and a detection source, wherein the detection source uses at least one of an optical, electro-optical, electromagnetic, radar, and thermal detection means.

14. The method of claim 13, wherein at least some of the fibers are a carbon fiber material.

15. The method of claim 13, wherein at least some of the fibers are a carbon fiber nanotube material.

16. The method of claim 13, wherein a coating is applied to at least some of the fibers.

17. The method of claim 13, wherein a coating is applied to the mesh of fibers as a whole.

18. A method of making a camouflage device, comprising:

providing a mesh of knitted fabric, wherein the mesh of knitted fabric is substantially one single layer; and fixedly deforming the mesh of knitted fabric by at least one of mechanical and thermal means to alter an electromagnetic property of the mesh of knitted fabric;

wherein the substantially one single layer is the only layer of the camouflage device.

19. The method of claim 18, further comprising applying a coating to the mesh of knitted fabric.

20. The method of claim 18, wherein at least some of the fibers are a carbon fiber material.

* * * * *